US007675225B2

(12) United States Patent
Wu

(10) Patent No.: US 7,675,225 B2
(45) Date of Patent: Mar. 9, 2010

(54) ENERGY SAVING LAMP HAVING ISOLATED BULB AND BASE STRUCTURE

(76) Inventor: Ti Hsien Wu, No. 164-9, Alley 9, Lane 287, Sec. 3, Chung Shan Rd., Tan Tzu Hsiang, Taichung Hsien (TW)

( * ) Notice: Subject to any disclaimer, the term of this patent is extended or adjusted under 35 U.S.C. 154(b) by 309 days.

(21) Appl. No.: 11/878,955

(22) Filed: Jul. 30, 2007

(65) Prior Publication Data

US 2009/0033197 A1 Feb. 5, 2009

(51) Int. Cl.
*H01J 5/48* (2006.01)

(52) U.S. Cl. ..... 313/318.01; 313/318.09

(58) Field of Classification Search ..... 313/318.01, 313/318.03, 318.04, 318.05, 318.09, 318.1, 313/318.12

See application file for complete search history.

(56) References Cited

U.S. PATENT DOCUMENTS 5,709,450 A * 1/1998 Francis et al. ..... 362/546

* cited by examiner

*Primary Examiner*—Vip Patel
(74) *Attorney, Agent, or Firm*—Rosenberg, Klein & Lee

(57) ABSTRACT

An energy saving lamp, containing an isolated bulb set and assembling base, wherein the bulb set is comprised of a main body, a bulb and a lid, and the assembling base is comprised of a main seat, a circular wall, a ballast and a bottom lid. A conductive and assembling structure are provided between said bulb set and the assembling base such that the bulb set and the assembling base can be disassembled and re-assembled freely, thus making it feasible to replace the malfunctioned parts of the lamp, achieving in the purpose of lower cost and reparability.

10 Claims, 11 Drawing Sheets

ENERGY SAVING LAMP HAVING ISOLATED BULB AND BASE STRUCTURE

BACKGROUND OF THE INVENTION

1. Field of the Invention

The present invention relates to an energy saving lamp. More particularly, the present invention relates to a lamp that has an isolated bulb and base structure.

2. Description of Related Art

A conventional energy saving lamp is shown in FIG. 11, which includes a bulb 31 and a base 31, wherein the base 31 has an electrical ballast 310 (not shown) installed inside, and the bulb 31 is integrated with the base 31 through the use of a glue. However, the aforesaid energy saving lamp contains some improvable defects, such as:

1. High cost: When the lamp malfunctions even partially, it is not possible to replace the bulb 31 or ballast 310 alone. Rather, the lamp must be replaced in its entirety, resulting in a high replacement cost.

2. Not repairable: When the lamp malfunctions partially, it is not possible to repair or replace the bulb 31 or ballast 310 alone. Rather, the lamp must be replaced in its entirety, and thus the lamp is not repairable.

The present invention is intended to improve upon the above drawbacks.

SUMMARY OF THE INVENTION

The primary object of the present invention is to provide an energy saving lamp comprising an isolated bulb set and assembling base with a conductive and assembling structure provided between said bulb set and assembling base such that the bulb set and the assembling base can be disassembled and reassembled freely, making it is feasible to replace a malfunctioning lamp part. Doing so achieves the purpose of lower cost and reparability.

Other objects, advantages and novel features of the invention will become more apparent in the following detailed description taken in conjunction with the accompanying diagrams.

DETAILED DESCRIPTION OF PREFERRED EMBODIMENT

Figure 1:
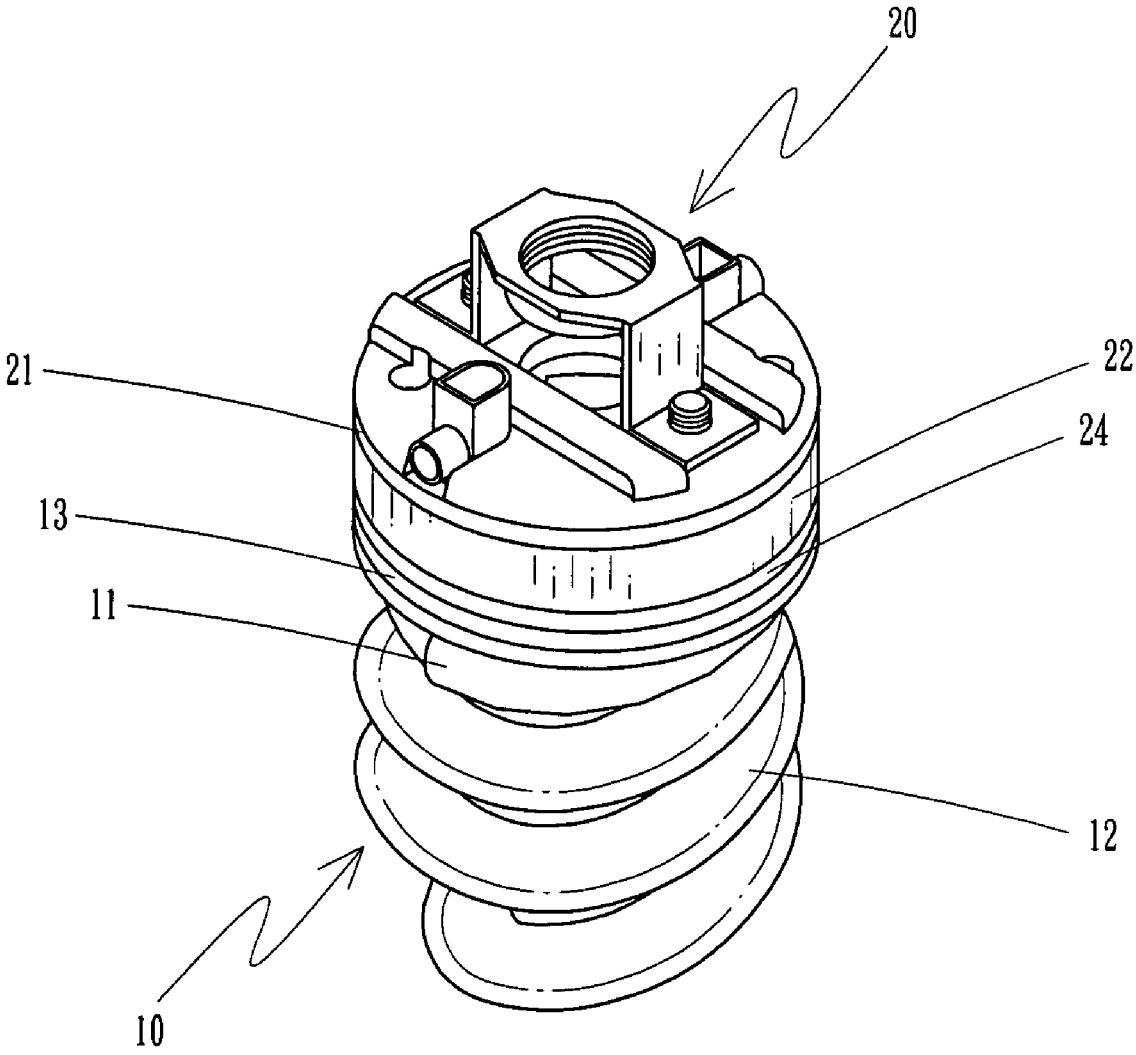
FIG. 1 is a perspective view schematically showing the first embodiment of the present invention.
Figure 2:
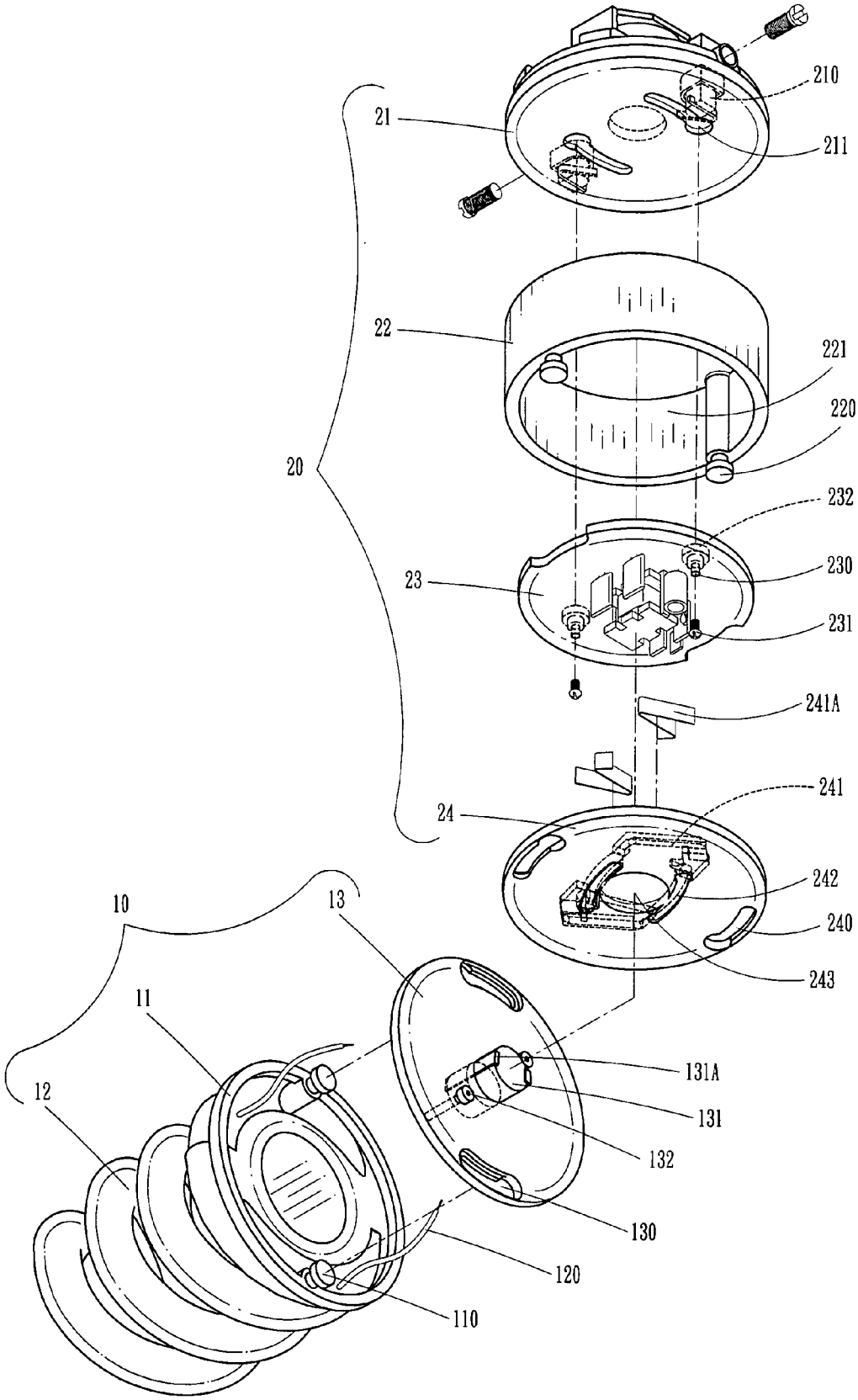
FIG. 2 is a segmented view of the first embodiment of the present invention.
Figure 3:
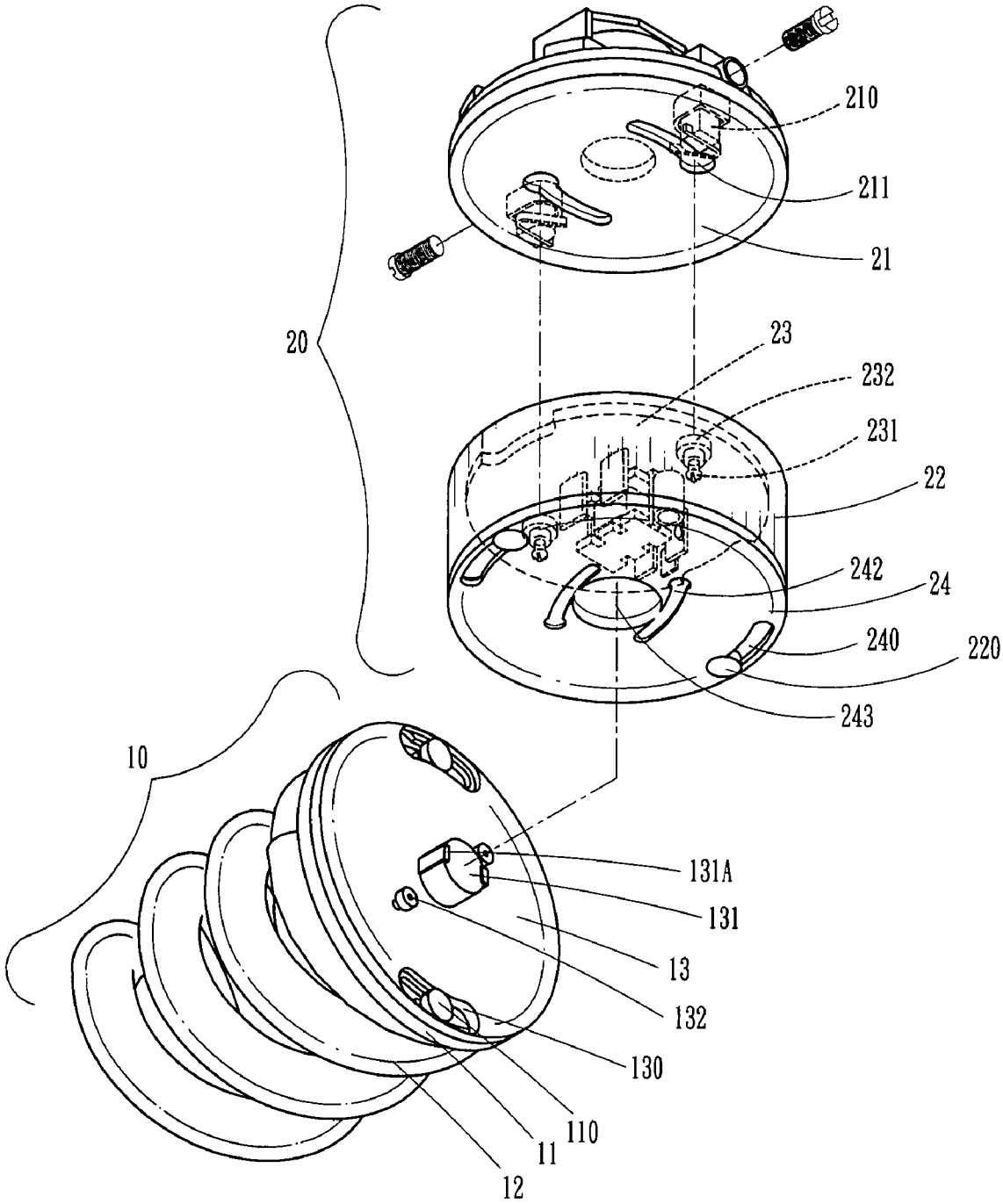
FIG. 3 is a segmented view, in partial section, of the first embodiment of the present invention.
Figure 4:
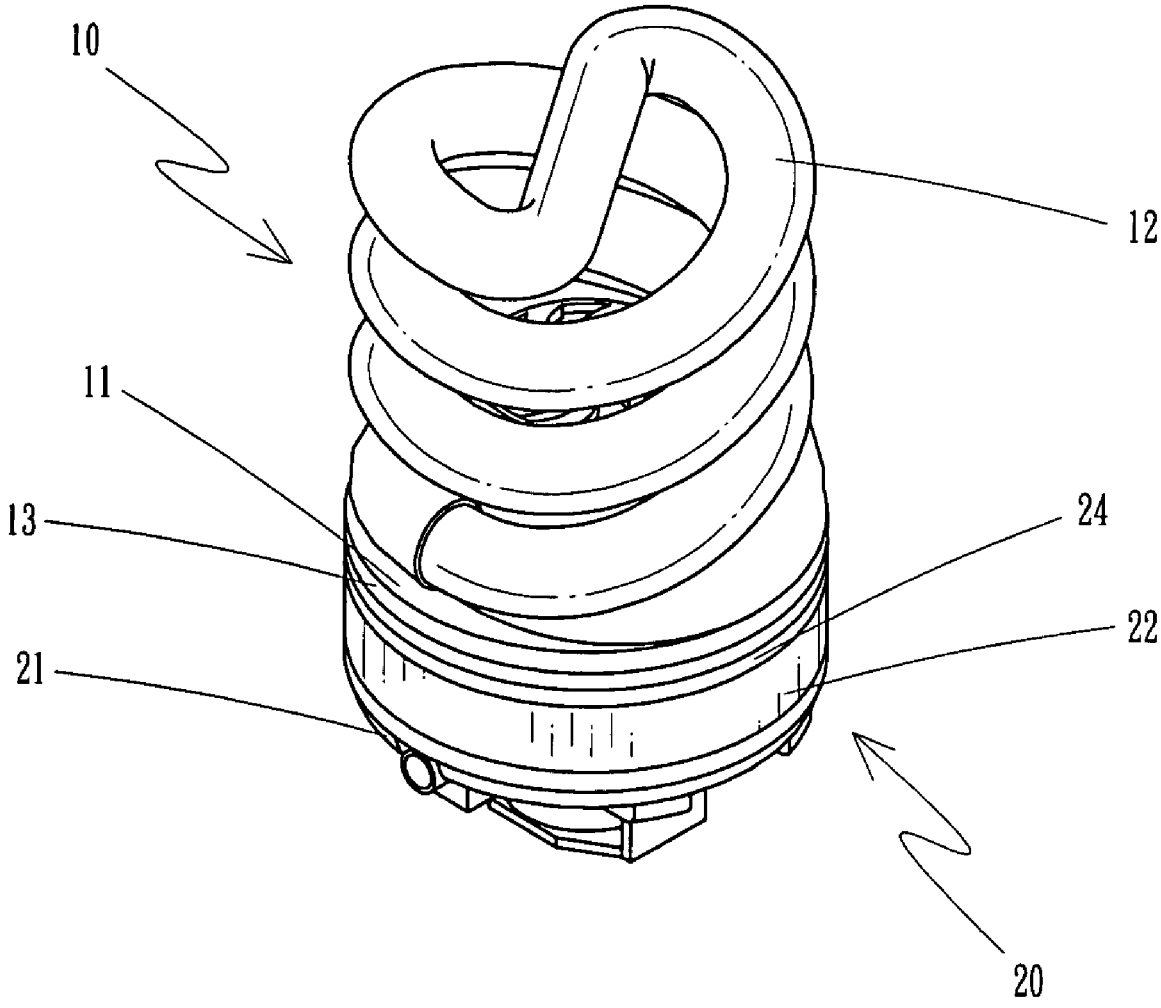
FIG. 4 is a segmented view, from a different angle, of the first embodiment of the present invention.

While this invention is capable of embodiment in many different forms, shown in the drawings and herein described in detail is the preferred embodiment of the invention. The preferred embodiment is disclosed with the understanding that the present description is but one example of the principles of the invention and is not intended to limit the broad aspects of the invention to the single embodiment illustrated.

FIGS. 1 to 4 are perspective and cross-sectional views schematically showing an energy saving lamp in accordance with the first embodiment of the present invention.

The lamp comprises:

an isolated bulb set 10 and assembling base 20, wherein, the bulb set 10 includes a main body 11, a bulb 12 and a lid 13. The main body 11 is combined with the bulb 12, a latch 110 is provided on the main body 11, and an electric wire 120 is connected with the bulb 12. In addition, the lid 13 comprises a groove 130, a post 131 and a positioning stick 132. Further, conductive pieces 131A are provide on the opposite of the post 131 which pass through the lid 13 and are installed on the lid 13. The lid 13 is assembled to the main body 11, i.e., the latch 110 of the main body 11 is passed through the groove 130 of the lid 13, thus locking the lid 13 with the main body 11 by being screwed in to one another. The wire 120 of the bulb 12 is also passed through the lid 13 and connected with the conductive pieces 131A of the lid 13. In addition, the post 131, the positioning stick 132 of the lid 13, and the conductive pieces 131A of the post 131 are all connected to the assembling base 20.

The assembling base 20 comprises a main seat 21, a circular wall 22, a ballast 23 and a bottom lid 24, wherein an elastic conductive piece 210 is installed in the main seat 21. A locking groove 211 is provided opposite of said conductive piece 210, and the circular wall 22 comprises a latch 220 and an inner space 221. A through hole 230 is provided on the ballast 23 where a fastener 231 can be passed through the hole 230 and fastens a conductive part 232 to the ballast 23. The ballast 23 is installed in the inner space 221 of the circular wall 22, and the conductive part 232 of the ballast 23 is locked with the locking groove 211 of the main seat 21 by being screwed in to one another. This allows the conductive part 232 which passed through the locking groove 211 to be conducted with the elastic conductive piece 210. In addition, the bottom lid 24, comprises an assembling groove 240, a conductive parts receptacle 241 a positioning groove 242 and a center hole 243, wherein the assembling groove 240 is provided to lock into the latch 220 of the circular wall 22 and the conductive parts receptacle 241 is provided for placement of the conductive pieces 241A and which is located opposite the positioning groove 242. The positioning groove 242 and the center hole 243 are provided to assemble with the post 131 and the positioning stick 132 of the lid 13 by being screwed in to one another and locking with each other, such that the opposing conductive pieces 241A and 131A conduct with each other.

Figure 5:
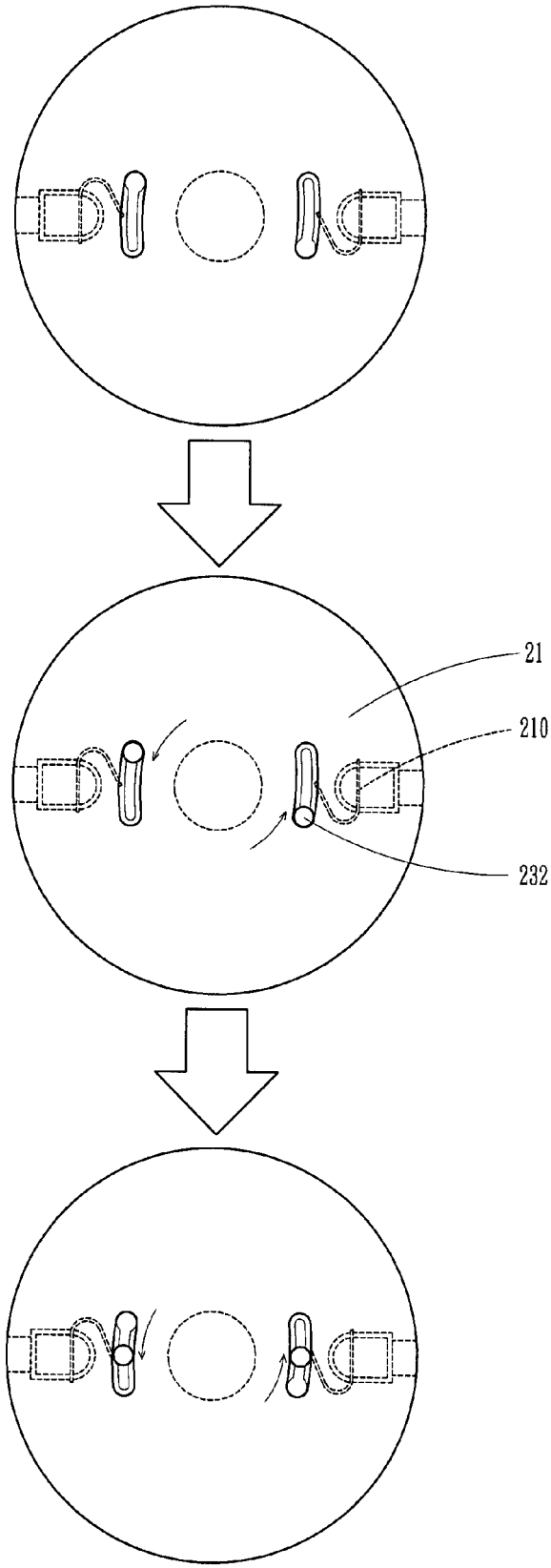
FIG. 5 is a elevational view schematically showing the assembly action of the first embodiment of the present invention.
Figure 6:
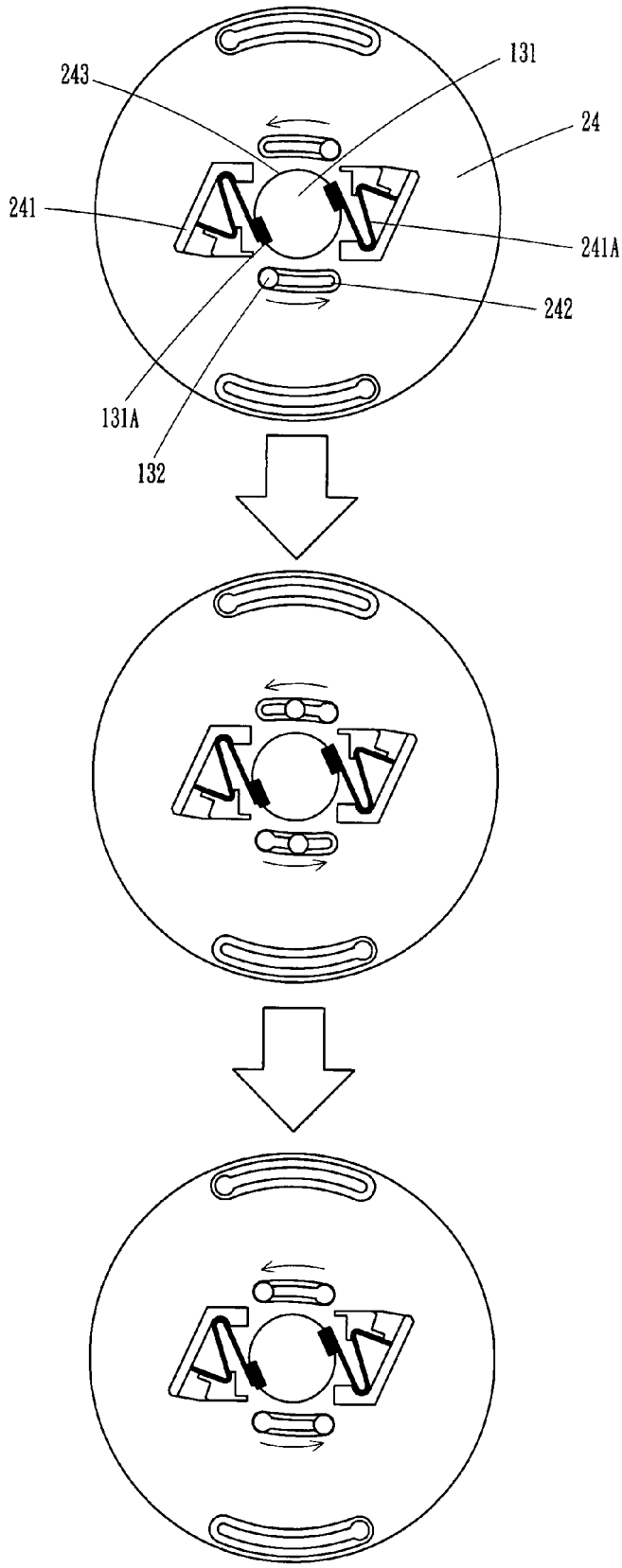
FIG. 6 is a elevational view schematically showing the assembly of a top lid and a bottom lid of the first embodiment of the present invention.

FIGS. 5 and 6 are elevational views showing the assembling action of the main seat 21 and the ballast 23, as well as that of the lid 13 and the bottom lid 24 of the present invention. The elastic conductive piece 210 is installed in a position that corresponds with the locking groove 211 of the main seat 21, and the conductive part 232 of the ballast 23 is locked with the locking groove 211 of the main seat 21 by being screwed in to one another, allowing the conductive part 232 to conduct with the elastic conductive piece 210 of the main seat 21. In addition, the conductive pieces 131A are provided on the opposite of the post 131, and the conductive pieces 241A are provided in the conductive parts receptacle 241, which corresponds to the assembling groove 240. The positioning stick 132 of the lid 13 is passed through and combined with the positioning groove 242 of the bottom lid 24 by being screwed in to one another. The post 131 is passed through the center hole 243 of the bottom lid 24 so that the conductive pieces 131A opposite the post 131 are conducted with the conductive pieces 241A of the bottom lid 24. Given the structure above, when the components of the bulb set 10 and the assembling base 20 malfunction, they can be replaced individually, achieving the goals of lower cost and reparability.

Figure 7:
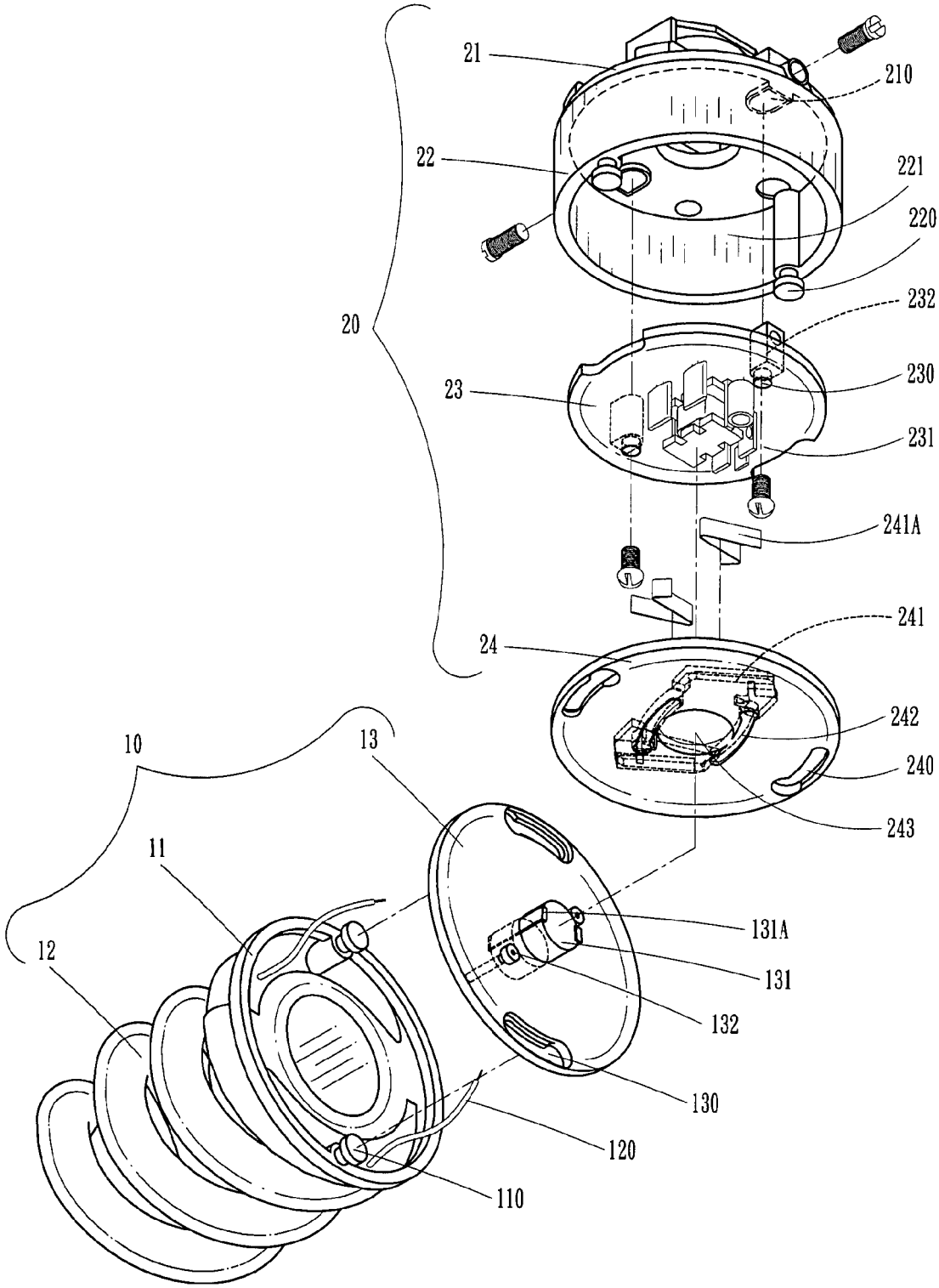
FIG. 7 is a segmented view of a second embodiment of the present invention.
Figure 8:
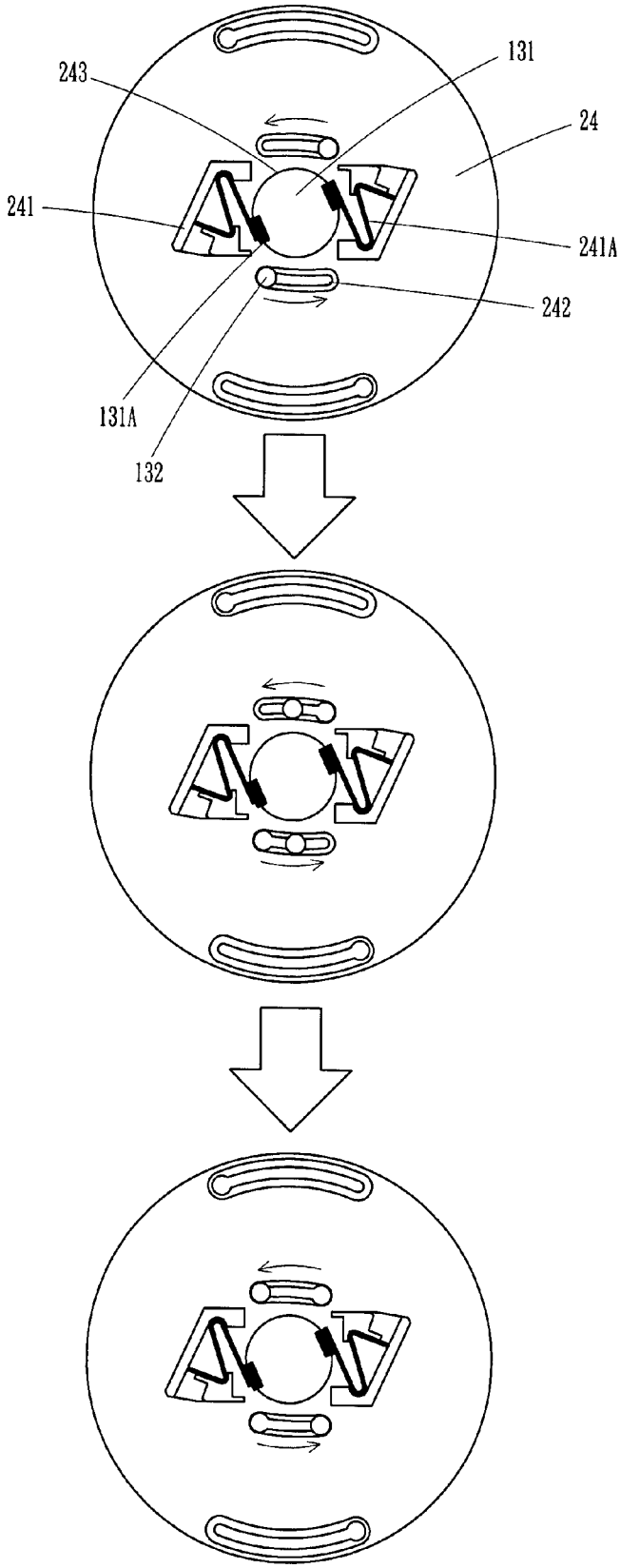
FIG. 8 is a elevational view schematically showing the assembly of a top lid and a bottom lid of the second embodiment of the present invention.

FIGS. 7 and 8 are segmented and plan views of the second embodiment of the present invention. Similar to the aforesaid first embodiment shown and described in FIGS. 1 through 6, the only difference between the second embodiment and the first embodiment is that the main seat 21 and the circular wall 22 of the second embodiment are integrated into a single unit, wherein a through hole 212 is defined on the main seat 21 which is provided to allow the conductive part 232 of the ballast 23 to pass through. In light of the structure given above, the structure of the present invention is simplified.

Figure 9:
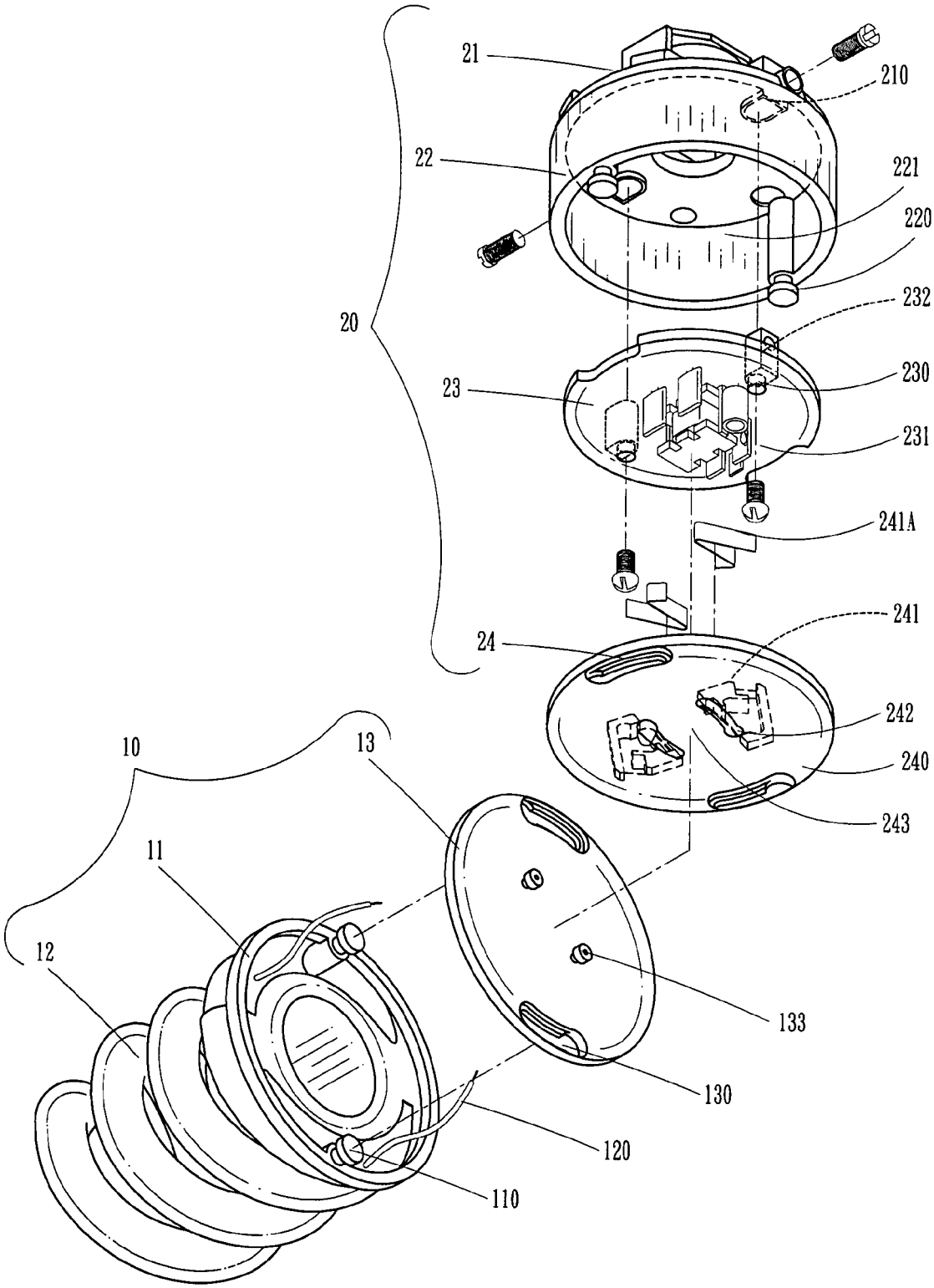
FIG. 9 is a segmented view of a third embodiment of the present invention.
Figure 10:
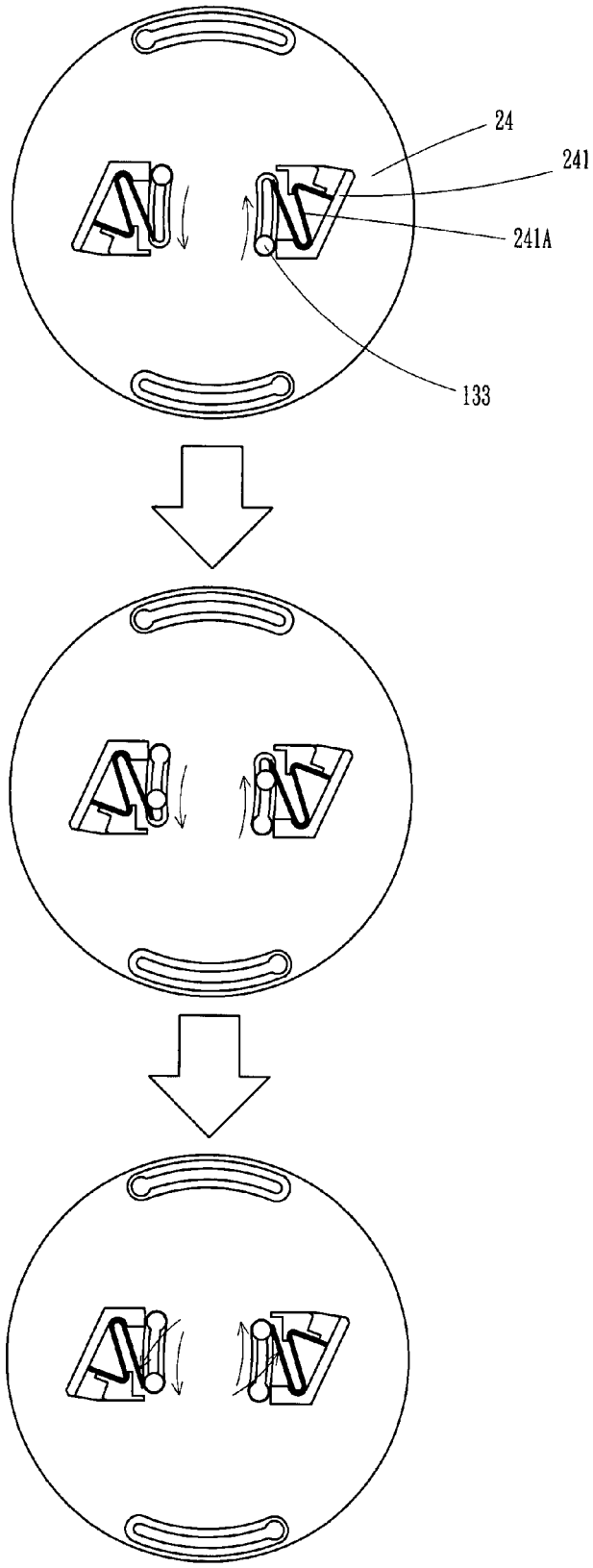
FIG. 10 is a elevational view schematically showing the assembling of a top lid and a bottom lid of the third embodiment of the present invention.
Figure 11:
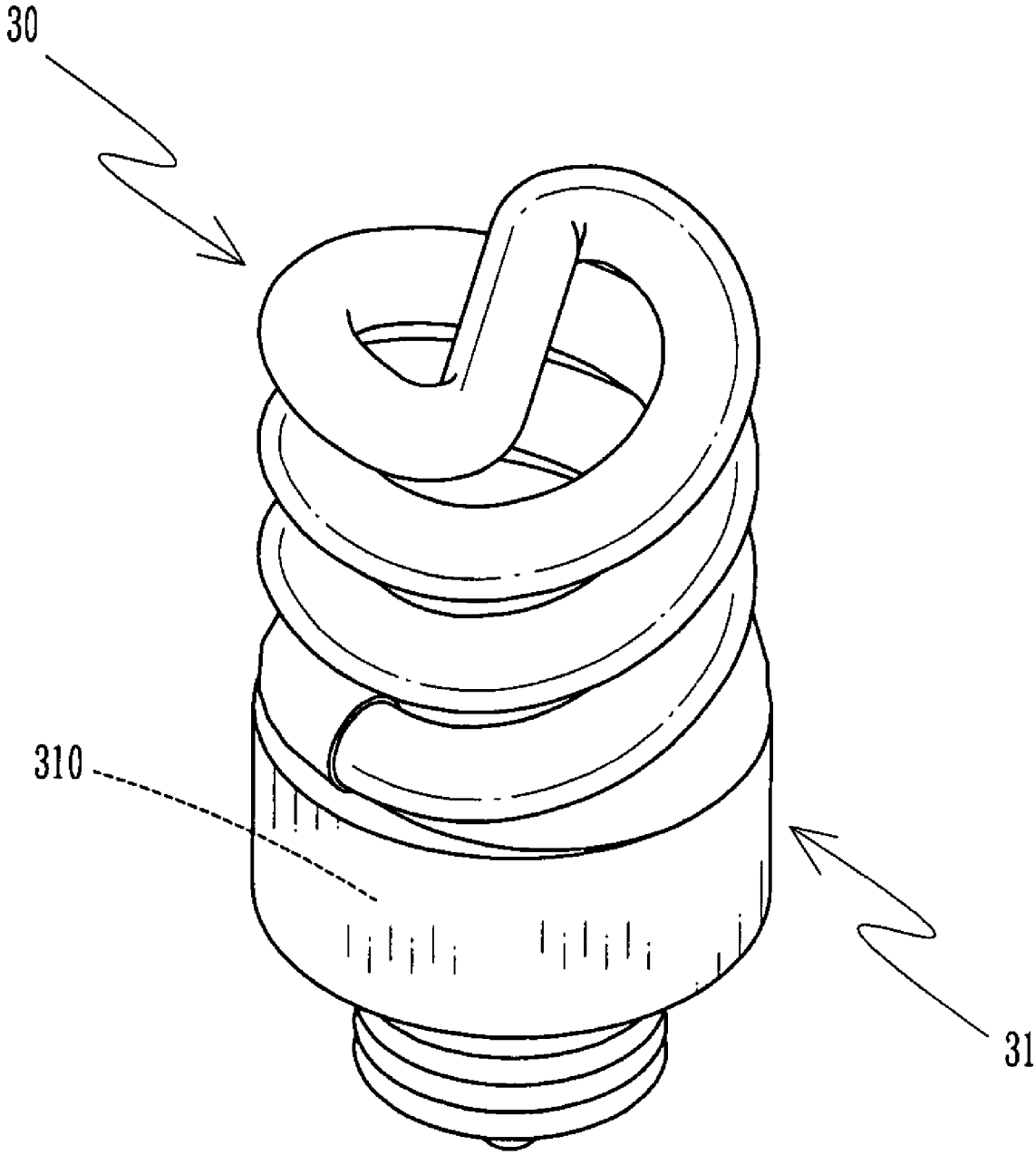
PRIOR ART FIG. 11
FIG. 11 is a segmented view schematically showing a conventional energy saving lamp.

FIGS. 9 and 10 are segmented and elevational views of the third embodiment of the present invention. Similar to the second embodiment, the main seat 21 and the circular wall 22 are integrated, and a through hole 212 is defined on such main seat 21 which is provided to allow the conductive part 232 of the ballast 23 to pass through. In addition, a conductive positioning stick 133 is installed on the ballast 23. One end of the conductive positioning stick 133 is connected with the electric wire 120 of the bulb 12, and the conductive pieces 241A are installed on the bottom lid 24 and correspond to the positioning groove 242. The conductive positioning stick 133 is passed through and locked with the positioning groove 242 by being screwed in to one another. The positioning stick 133 can thus conduct with the conductive pieces 241A.

In light of the structures described above, the advantages of the present invention include:

1. Lower cost: When the component of the lamp is no longer functioning, it is not necessary to replace the lamp in its entirety. Therefore, the advantage of cost saving is achieved.

2. Convenience in use: When the lamp is not properly functioning, it is only necessary to replace the bulb or the ballast. It is not necessary to disassemble the lamp by a destructive method.

Although numerous characteristics and advantages of the present invention have been set forth in the foregoing description, together with details of the structure and function of the invention, this disclosure is one example only, and changes may be made with regard to specific details, particularly in matters of shape, size, and arrangement of parts within the invention to the full extent indicated by the general meaning of the terms in which the appended claims are expressed.

What is claimed is:

1. An energy saving lamp, comprising:

a bulb set having a main body, a bulb and a first lid; one end of the main body is combined with the bulb, and the other end of the main body is combined with the first lid; an electric wire is connected with the bulb and conductive pieces are provided on the first lid; the electric wire of the bulb is connected with one end of the conductive pieces;

an assembling base having a main seat, a circular wall, a ballast and a second lid, wherein an elastic conductive piece is installed in the main seat, a locking groove is provided opposite of said conductive piece; additionally, the circular wall comprises an inner space, and a conductive part is provided on the ballast, the ballast is installed in the inner space of the circular wall, and the conductive part of the ballast is conducted with the elastic conductive piece located in the locking groove of the main seat; in addition, the second lid comprises a conductive parts receptacle and a positioning groove, wherein the conductive parts receptacle is provided for placement of the conductive pieces, and it is located opposite the positioning groove; the second lid is combined with the circular wall and the positioning groove is combined and locked with the conductive pieces of the bulb set by being screwed in to one another, so to allow the conductive pieces and the conductive pieces to conduct.

2. The energy saving lamp of claim 1, wherein a latch is provided on the main body and a groove is provided on the first lid; when assembling, the latch of the main body is combined and locked with the groove of the first lid by being screwed in to one another.

3. The energy saving lamp of claim 1, wherein the first lid further comprises a post and a positioning stick; the conductive pieces are positioned opposite the post; the conductive pieces are passed through the first lid and connected with the electric wire of the bulb; in addition, a latch is provided on the main body and a groove is provided on the first lid, the latch being passed through and locked with the groove of the first lid; the post and the positioning stick of the lid, and the conductive pieces of the post, all being combined and conduct with the assembling base.

4. The energy saving lamp of claim 1, wherein a center hole is defined on the second lid, and this center hole is provided for the assembly of the post and for the conductive pieces of the first lid to pass through.

5. The energy saving lamp of claim 1, wherein the first lid further comprises a conductive positioning stick which is passed through the first lid and connected with the electric wire of the bulb; a latch is provided on the main body and a groove is provided on the first lid, the latch being combined and locked with the groove of the first lid by being screwed in to one another, and the conductive positioning stick of the lid being combined and conducts with the assembling base.

6. The energy saving lamp of claim 1, wherein the main seat and the circular wall are separated.

7. The energy saving lamp of claim 1, wherein the main seat and the circular wall are integrated.

8. The energy saving lamp of claim 1, wherein a through hole is provided on the ballast where a fastener is passed through the hole and secures a conductive part to the ballast.

9. The energy saving lamp of claim 1, wherein the conductive part of the ballast is combined and locked with the locking groove of the main seat by being screwed in to one another, so that the conductive part which passes through the locking groove can conduct with the elastic conductive piece.

10. The energy saving lamp of claim 1, wherein an assembling groove is provided on the second lid, and a latch is provided on the circular wall, wherein the assembling groove of the second lid is combined and locked with the latch of the circular wall by being screwed to one another.

* * * * *